United States Patent [19]

Frick, Jr.

[11] 4,169,328

[45] Oct. 2, 1979

[54] MODULAR DISPLAY SIGN SYSTEM

[76] Inventor: William G. Frick, Jr., 2240 White Oak Dr., Northbrook, Ill. 60062

[21] Appl. No.: 799,380

[22] Filed: May 23, 1977

[51] Int. Cl.[2] ..... G09F 7/02

[52] U.S. Cl. ..... 40/612; 116/63 R

[58] Field of Search ..... 40/10 R, 606, 124.1, 40/618, 594, 595, 612, 618, 584; 116/63, 63 P

[56] References Cited

U.S. PATENT DOCUMENTS

| | | | |
|---|---|---|---|
| 1,830,960 | 11/1931 | Philibert | 40/595 |
| 2,936,540 | 5/1960 | Power | 40/594 |
| 3,369,312 | 2/1968 | Chrietzberg | 40/618 |
| 3,496,665 | 2/1970 | Goldman | 40/618 |
| 3,525,493 | 8/1970 | Chrietzberg | 40/606 |
| 3,600,812 | 8/1971 | Cromoga | 40/594 X |
| 4,060,920 | 12/1977 | Edwards | 40/618 |
| 4,073,612 | 2/1978 | Nitta | 40/10 R |

*Primary Examiner*—Louis G. Mancene
*Assistant Examiner*—Wenceslao J. Contreras

[57] ABSTRACT

A modular display sign system comprising a display panel, struts integrally formed into the panel for support of the sign, a fastening system employing both an adhesive pad and fastening members for affixation of the sign to a desired point of use, and an interchangeable system of labels designed for affixation to the sign in order to convey a variety of messages.

9 Claims, 6 Drawing Figures

MODULAR DISPLAY SIGN SYSTEM

BACKGROUND OF THE INVENTION

The use of display signs to convey information and to advertise products is as old as civilization itself. Writing and accompanying pictorial displays have traditionally been placed in close juxtaposition to goods or services offered for sale. The shape and style of these signs is as varied as the messages they convey. However, in the past, difficulties have arisen in relation to affixation of the sign to a desired point of use, ability to place a variety of desired messages on a single display, ability to change the message transcribed on a sign, and the amount of time and effort necessary to transcribe a given message onto a given sign, and affix the sign to the desired point of use.

Previous attempts at overcoming these difficulties have utilized a number of methods, depending on the particular application intended. One of the more recurring areas of development has been the display of multi-message sign members. One of the devices utilized has been a series of slats, integrally connected with a designated message on each slat. Another alternative has been a single sign member having a series of slots and openings for insertion of printed cards into the sign. A method commonly utilized on outdoor billboard displays consists of applying a paste to the billboard display and then affixing sections of preprinted paper to the sign.

Several methods have also been utilized to affix a sign to a desired point of use. Among these are the use of bolts or screws, the use of a base wide enough to support the sign independently, or the affixation of the sign by means of wire or rope.

Nevertheless, problems have remained in connection with both the display of several messages on the same sign, and the affixation of the sign to the desired point of use. Among these are the creation of signs which indicate direction by shape and graphics, but still may be used for a variety of directions. A second difficulty has been where a particular user has a series of interchangeable messages to be displayed on a plurality of signs, but is not aware of the precise message required at each individual location. Another difficulty has been in holding the sign at its desired position during installation, without the use of hoists or additional manpower.

Accordingly, it is an object of the present invention:

- to provide modular display sign systems that are inexpensive and simple to affix to a desired point of use;
- to provide such sign systems that allow the exact content of the desired measage to be determined at the point of use;
- to provide such sign systems that allow inexpensive and simple transcription of a desired measage onto the sign;
- to provide such systems that are adaptable to a variety of messages, shapes and content; and
- to provide sign systems that allow indication of direction by geometric shape and graphics but may be utilized to indicate alternative direction.

SUMMARY OF THE INVENTION

The present invention is a modular display sign system. The invention comprises a panel for the display of visual communications, struts integrally formed into the panel for the support of the sign, a system for fastening the sign to a desired point of use, and a system of labels designed for affixation to the sign in order to convey a variety of messages.

In one embodiment of the invention, the previously mentioned panel is rectangular in shape and has a plurality of alternating square and rectangular indentations therein. The alternating indentations enable the positioning of an emblem printed on a square label at the beginning of a message, followed by a variety of interchangeable messages on a rectangular label, all as a single unit. A second square indentation following the message allows the display of an arrow, printed on a square label, so that the sign may be affixed either vertically or horizontally, while still allowing the arrow to indicate the desired directional message.

In one embodiment of the invention, the struts previously mentioned, comprise a plurality of arcuate members integrally formed perpendicular to one end of the panel. The struts are formed on opposite sides of the panel in order to provide uniform support. The struts terminate on a plane perpendicular to the end of the panel.

In a preferred embodiment of the invention, an additional pair of strut members is formed co-planar with the panel itself and arching from the top and bottom edges respectively of the panel at one end of the sign.

In a preferred embodiment of the invention, the means for fastening signs to a desired point of use comprises a base member integrally formed at the first end of the panel, and perpendicular to the panel itself. A plurality of fastening members, such as screws or bolts are fixedly engaged through the base member to the desired point of use. A plurality of corresponding apertures through the base member allows easy insertion of the fastening members through the base.

In a preferred embodiment of the invention, these apertures, or fastening aperture means, are channels running between the struts and through the base member, so that fastening members can be held in place during affixation and for concealment of the fastening members after insertion.

An additional embodiment of the fastening system, or fastening means, as they are called in the claims, comprises an adhesive pad, fixedly attached to the outside surface of the base member. This pad is used for affixation of the sign to the desired point of use before engagement of the fastening members. Thus, the user can select the point of use, affix the sign to it, using the adhesive pad, and then secure the sign more firmly with bolts or screws. This is a tremendous improvement over previous signs which required being manually held in position during affixation.

In a preferred embodiment, this adhesive pad comprises an aerated cellular plastic cushion, having a pressure-sensitive adhesive coating across the outside surface of the pad. A peelable cover sheet is removably attached to the outside surface of the adhesive coating.

In a preferred embodiment of the invention, the label system, or label means, as they are called in the claims, comprise a plurality of pressure-sensitive labels having a series of visual communications or messages thereon. These plurality of labels are either square or rectangular, as desired, so as to correspond in shape to the indentation in the panel means.

In a preferred embodiment of the invention, the label means have a peelable pressure-sensitive adhesive fixedly attached to one side of the label, so as to allow removal and replacement of the labels on the sign as desired.

Also disclosed by the invention, is a method of displaying a plurality of interchangeable sign messages on a modular display sign system. A plurality of pressure-sensitive labels, having a variety of interchangeable sign messages are selected, as needed, and attached to correspondingly shaped indentations in the modular display sign. The modular display sign is then affixed to the desired point of use by an adhesive pad. A plurality of fasteners is inserted into corresponding apertures in the base of the modular sign. The fasteners are then screwed through the base member and to the desired point of use.

The invention additionally discloses a method of forming a modular display sign, which comprises five steps. The first step is to cast a mold for a single rectangular panel having indentations across its horizontal surface, a plurality of struts emanating from one end of the panel and a flat base member perpendicular to both the panel and the struts. The second step comprises heating a plurality of plastic pellets until the pellets melt into a viscous liquid. The third step comprises injecting the viscous plastic liquid into the mold. The fourth step is to cool the mold. Finally, the fifth step is to remove the sign from the mold, ready for use.

DETAILED DESCRIPTION OF THE DRAWINGS

Figure 1:
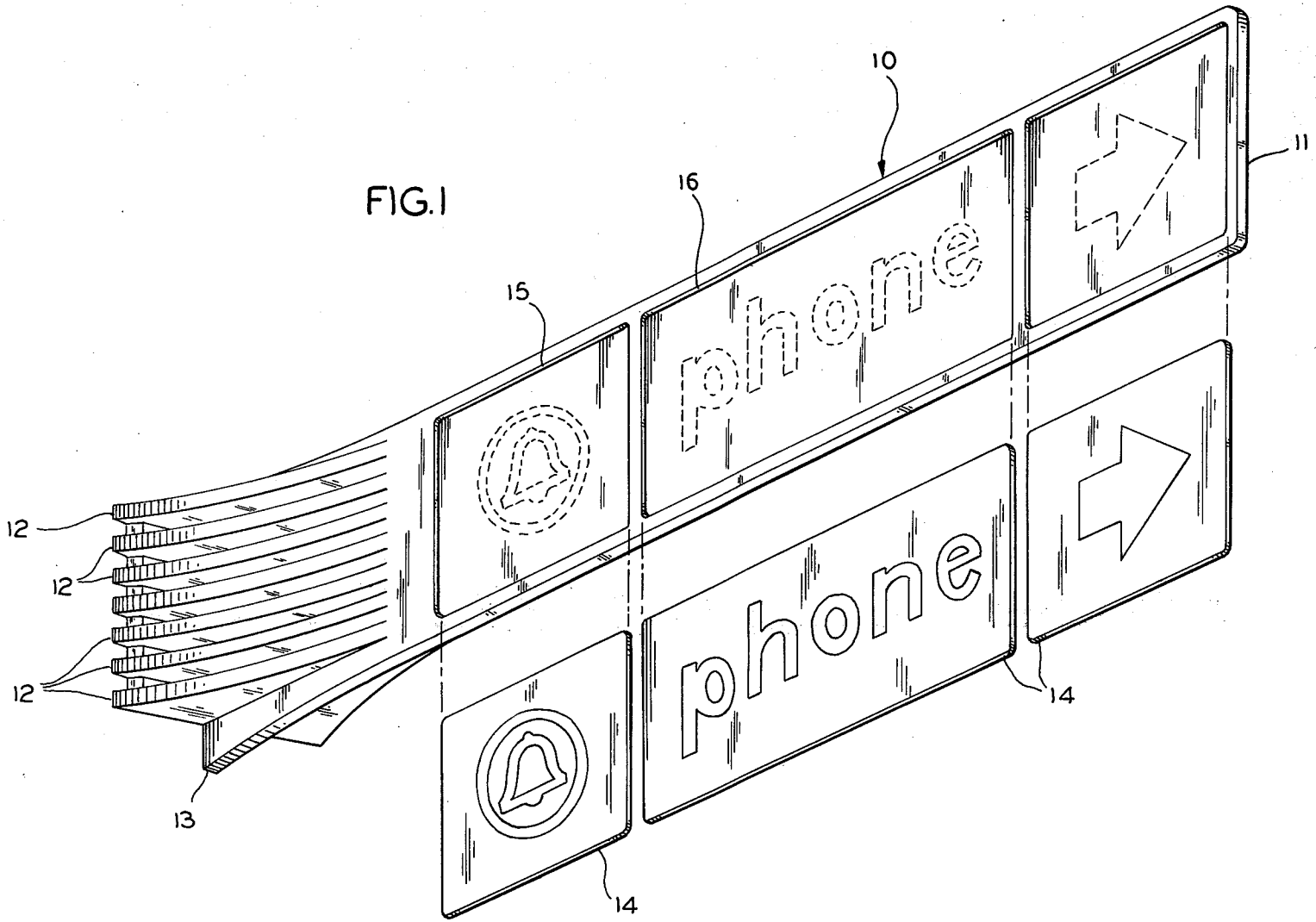
FIG. 1 of the drawings is a perspective view of the invention.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Modular display sign system 10, as shown in FIG. 1 comprises a substantially rectangular panel member 11. Strut means 12 are integrally formed at a first end 13, of panel member 11, for the support of panel member 11 in a desired operative position. Label means 14 are utilized to affix a variety of visual communications to panel member 11.

Panel member 11, has a plurality of alternating square insertions 15, and rectangular insertions 16. These alternating indentations, 15 and 16, allow the insertion of label means 14, as desired.

Figure 2:
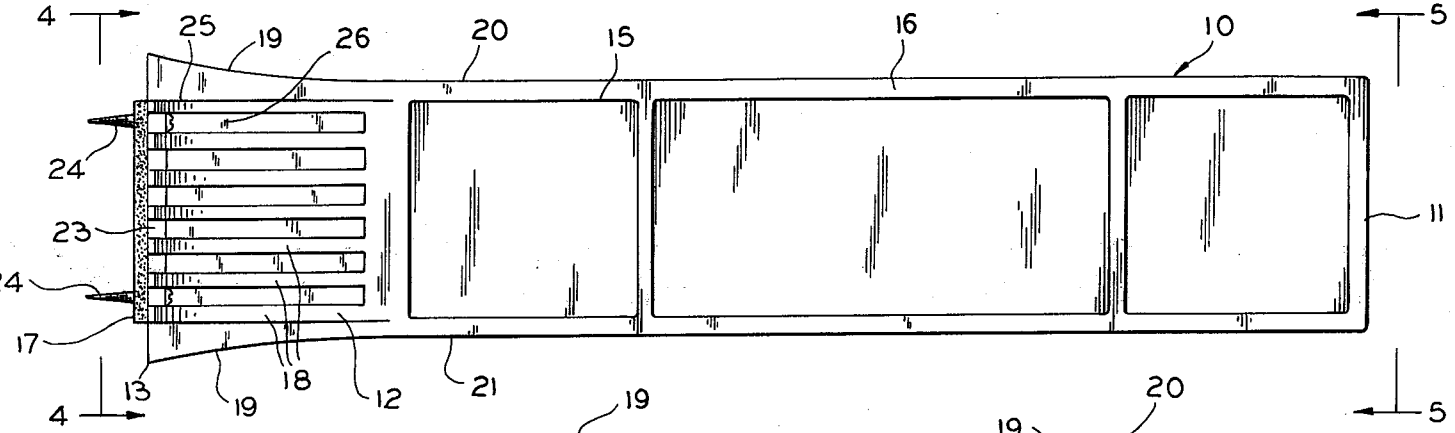
FIG. 2 of the drawings is a side elevational view of the invention.

Shown in FIG. 2 are fastening means 17 for securement of panel member 11 to a desired point of use. Additionally shown in FIG. 2 are strut means 12, which comprise a plurality of arched strut members 18, integrally formed perpendicular to first end 13 of panel member 11. Strut members 18 are formed in pairs, each to the opposite side of panel means 11, (more clearly shown in FIG. 5). Also shown in FIG. 2 are co-planar strut members 19, integrally formed in first end 13 of panel member 11 and emanating from top edge 20 and bottom edge 21 of panel member 11. Base member 23 is perpendicular to panel means 11. A plurality of fastening members 24, are fixedly engaged through base member 23 and to a desired point of use. Additionally, fastening aperture means 25 allow insertion of fastening members 24 through base member 23.

In one embodiment of the invention, fastening aperture means 25 comprise fastening aperture channels 26, running between strut means 12 and through base member 23, for the insertion of fastening members 24 during affixation of the invention and for concealment of fastening members 24 after insertion.

Figure 3:
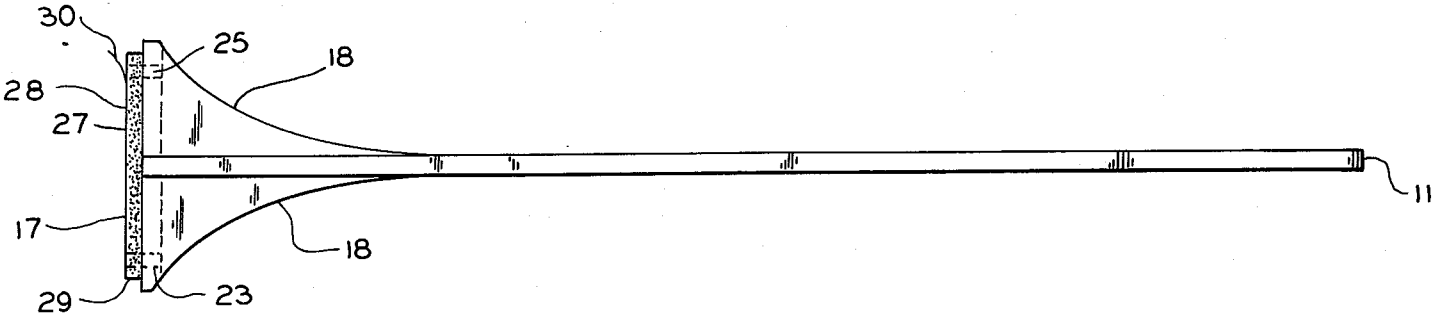
FIG. 3 of the drawings is a top plan view of the invention.

As shown in FIG. 3 of the drawings, arcuate strut members 18 are formed in pairs on each side of panel means 11. Also shown in FIG. 3 is a further embodiment of fastening means 17, which comprises adhesive pad means 27, for affixation of modular display sign system 10 to a desired point of use before engagement of fastening members 24 to the same desired point of use. In one embodiment of the invention, adhesive pad means 27 comprises an aerated cellular plastic cushion 48, fixedly attached to the outside surface of base member 23. A pressure-sensitive adhesive coating 29, is coated across the outside surface of cushion 28. A peelable cover sheet member 30 is removably attached to the outside surface of adhesive coating 29.

Figure 4:
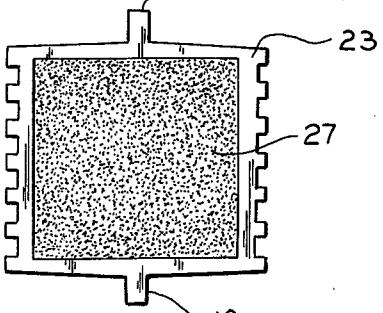
FIG. 4 is a back plan view of the invention.

Shown more clearly in FIG. 4 of the drawings are co-planar strut members 19, base member 23, fastening aperture means 25 and adhesive pad means 27.

Figure 5:
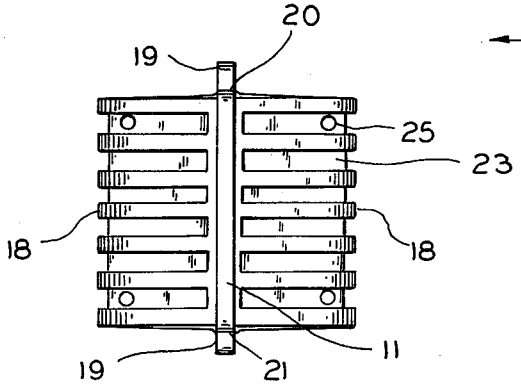
FIG. 5 is a front plan view of the invention.

Clearly shown in FIG. 5 are arcuate strut members 18 formed in pairs on opposite sides of panel means 11, co-planar strut members 19, formed at a top edge 20 and bottom edge 21 of panel means 11, and fastening aperture means 25 through base member 23.

Figure 6:
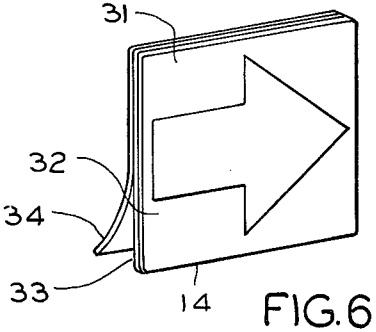
FIG. 6 is a front perspective view of the label means, showng, in particular, an adhesive coating and peelable cover stock.

As shown in FIG. 6 of the drawings, label means 14 comprise a plurality of pressure-sensitive adhesive label members 31, being either square or rectangular, as desired, so as to correspond in shape to indentations 15 and 16 in panel means 11. Pressure-sensitive adhesive label members 31 are constructed of a plastic outer surface 32, a pressure-sensitive adhesive coating 33, and a peelable cover stock 34. Adhesive coating 33 is comprised of a permanent adhesive, so as to not allow removal of adhesive label 31. Replacement on panel member 11 can be achieved by placing new label on top of current label.

In an alternative embodiment of the invention, adhesive coating 33 is comprised of a peelable pressure-sensitive adhesive which allows removal and replacement of label 31.

The foregoing description and drawings merely explain and illustrate the invention and the invention is not limited thereto, except insofar as the appended claims are so limited as those skilled in the art who have the disclosure before them will be able to make modifications and variations therein, without departing from the scope of the invention.

What is claimed is:

1. A modular display sign system which comprises:

assorted label means for adhesive affixation of a variety of visual communications to said display sign system;

a substantially rectangular panel member having a first and second end and having alternating square and rectangular indentations of equivalent height longitudinally positioned therein, said square indentations being positioned proximate said first and second ends of said panel member, said square indentations enabling placement of square label means describing a directional arrow, alternatively in a horizontal or vertical position as desired, thereby graphically and structurally communicating, in combination with said rectangular panel member, directional information;

strut means integrally formed at said first end of said panel means for supporting said panel member in a desired operative position; and fastening means for the securement of said panel member to a desired point of use.

2. The invention according to claim 1 in which said strut means comprises:

a plurality of arcuate strut members integrally formed perpendicular to said first end of said panel means and emanating therefrom, said plurality of arcuate strut members being formed in pairs, each to the opposite side of said panel means.

3. The invention according to claim 2 in which said strut means further comprises:

a pair of co-planar strut members integrally formed with said first end of said panel means and emanating from a top and bottom edge, respectively, of said panel means.

4. The invention according to claim 1 in which said fastening means comprises:

a base member integrally formed at said first end of said panel means;

said base member being perpendicular to said panel means;

a plurality or fastening members fixedly engaged through said base member and to said desired point of use; and a plurality of fastening aperture means for the insertion of said fastening members through said base member.

5. The invention according to claim 4 in which said fastening aperture means comprise:

fastening aperture channels running between said strut means and through said base member for the retention of said fastening members during affixation of the invention, and for concealment of said fastening members after insertion.

6. The invention according to claim 4 in which said fastening means further comprises:

adhesive pad means for affixation of said modular display sign system to said desired point of use before engagement of said fastening members to said desired point of use.

7. The invention according to claim 6 in which said adhesive pad means comprises:

an aerated cellular plastic cushion fixedly attached to the outside surface of said base member;

a pressure-sensitive adhesive coating across the outside surface of said cushion; and a peelable cover sheet member removably attached to the outside surface of said adhesive coating.

8. The invention according to claim 1 in which said label means comprises:

a plurality of pressure-sensitive adhesive label members having a series of visual communications thereon, said plurality of said pressure-sensitive adhesive label members being either square or rectangular, as desired, so as to correspond in shape to indentations in said panel means.

9. The invention according to claim 8 in which said label means further comprises:

peelable pressure-sensitive adhesive fixedly attached to said outside surface of said pressure-sensitive adhesive label members, so as to facilitate the removal and replacement of said adhesive label members on said panel means as desired.

* * * * *

UNITED STATES PATENT AND TRADEMARK OFFICE

CERTIFICATE OF CORRECTION

PATENT NO. : 4,169,328
DATED : October 2, 1979
INVENTOR(S) : WILLIAM G. FRICK

It is certified that error appears in the above-identified patent and that said Letters Patent are hereby corrected as shown below:

Col 4, line 24: After the word "cushion", "48" should read ---28---.

Signed and Sealed this

*Fifth* Day of *February 1980*

[SEAL]

*Attest:*

SIDNEY A. DIAMOND

*Attesting Officer*

*Commissioner of Patents and Trademarks*